United States Patent [19]

Oyama

[11] Patent Number: 5,031,252

[45] Date of Patent: Jul. 16, 1991

[54] TOILET STOOL SEAT DISINFECTING APPARATUS

[75] Inventor: Keiji Oyama, Osaka, Japan

[73] Assignee: Teisa Industrial Co., Ltd., Osaka, Japan

[21] Appl. No.: 467,543

[22] Filed: Jan. 19, 1990

[30] Foreign Application Priority Data

Jun. 8, 1989 [JP] Japan ..... 1-145699

[51] Int. Cl.[5] ..... A47K 13/30

[52] U.S. Cl. ..... 4/233; 4/222

[58] Field of Search ..... 4/222, 229, 230, 233, 4/304, 313, 623

[56] References Cited

U.S. PATENT DOCUMENTS

| | | | |
|---|---|---|---|
| 1,165,986 | 12/1915 | Mayo et al. | 4/233 |
| 1,591,746 | 7/1926 | Delaney | 4/233 |
| 2,551,882 | 5/1951 | Hartman | 4/233 |
| 3,344,441 | 10/1967 | Kelly | 4/233 |
| 3,371,355 | 3/1968 | Wipf | 4/222 |
| 3,590,397 | 7/1971 | Akamatsu | 4/313 |
| 4,309,781 | 1/1982 | Lissau | 4/304 |
| 4,625,342 | 12/1986 | Gangnath et al. | 4/222 X |
| 4,670,916 | 6/1987 | Bloom | 4/222 X |
| 4,790,036 | 12/1988 | Vogeli et al. | 4/233 |

FOREIGN PATENT DOCUMENTS

| | | | |
|---|---|---|---|
| 2501992 | 9/1982 | France | 4/313 |

*Primary Examiner*—Henry J. Recla
*Assistant Examiner*—Casey Jacyna
*Attorney, Agent, or Firm*—Wenderoth, Lind & Ponack

[57] ABSTRACT

The present invention is a toilet stool seat disinfecting apparatus comprising a body mounted in the rear portion of a toilet stool, a ray sensor unit installed in the body to detect the opening of the stool cover, a pair of nozzles installed at both sides of the body, the nozzles being connected to a disinfectant source through a flow way, and a controller circuit which controls opening of a flow way when the ray sensor detects the opening of the stool cover. The apparatus automatically sprays disinfectant to the stool seat when the stool cover is opened by a user of the toilet stool.

11 Claims, 2 Drawing Sheets

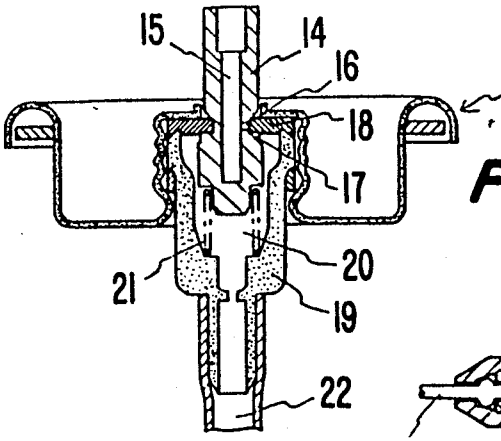
FIG. 6
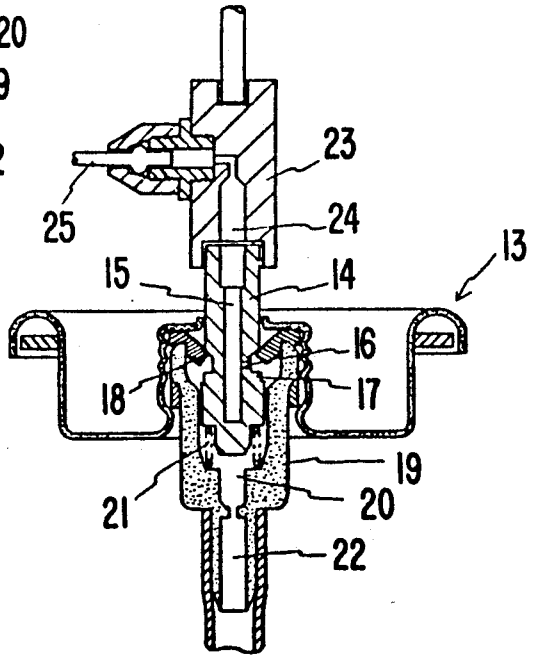
FIG. 7
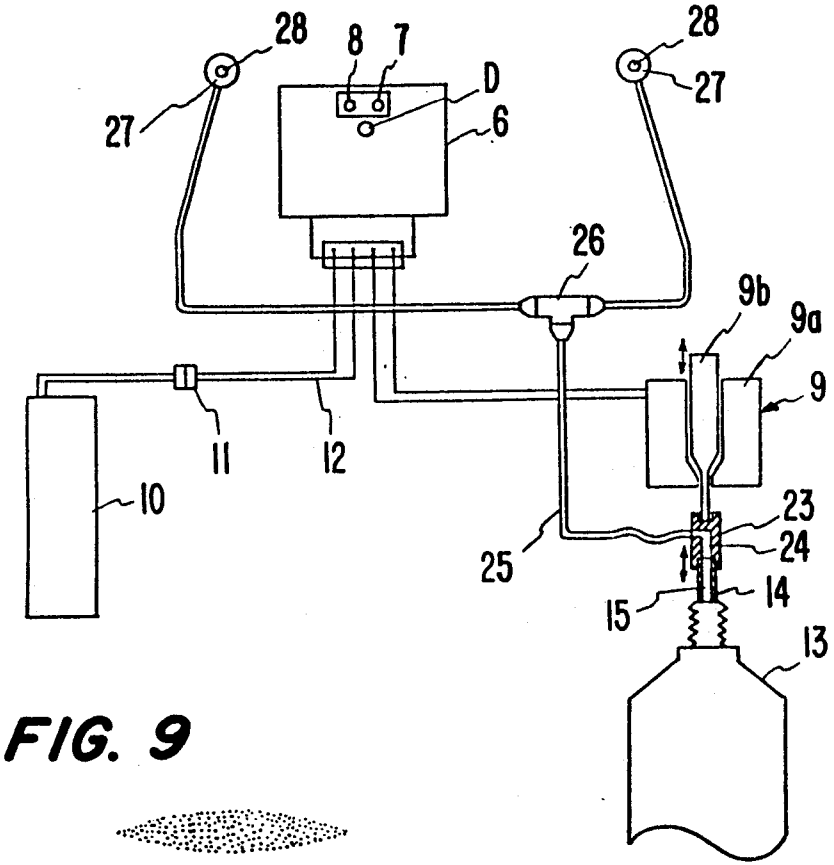
FIG. 5
FIG. 9

TOILET STOOL SEAT DISINFECTING APPARATUS

TECHNICAL FIELD

The present invention relates to a toilet stool seat disinfecting apparatus.

BACKGROUND ART

A toilet stool seat must be disinfected for the sanitary using of the stool. The disinfection of the toilet stool seat will prevent contagion in the toilet.

A paper covering method for the toilet stool seat is known, but this method is tiresome for users as well as expensive for owners of the toilet.

So some easily usable disinfecting apparatus for toilet stool seats must be developed.

That is, it is an object of the present invention to provide an easily usable disinfecting apparatus for a toilet stool seat.

It is another object of the present invention to provide a low operating cost disinfecting apparatus for a toilet stool seat.

DISCLOSURE OF THE INVENTION

To attain the stated objects, the present invention provides a toilet stool seat disinfecting apparatus comprising a body mounted in the rear portion of a toilet stool, a ray sensor unit installed in said body to detect the opening of the stool cover, a pair of nozzles installed in both sides of said body, said nozzles being connected to a disinfectant source through a flow way, and a controller circuit which acts to open said flow way when said ray sensor detects the opening of the stool cover.

The apparatus of the present invention automatically sprays disinfectant to the stool seat when the stool cover is opened by a user of the toilet stool.

The apparatus of the present invention only uses a small amount of electric power and disinfectant sprays and thus has a low operating cost.

BRIEF DESCRIPTION OF THE DRAWINGS

FIG. 5 is a diagram of an electrical connection and a disinfectant flow way of the apparatus according to the present invention;

FIG. 6 is a cross-sectional view of the upper portion of the disinfectant container of the apparatus according to the present invention;

FIG. 7 is a cross-sectional view similar to FIG. 6 except with the stem of the disinfectant container pushed down;

FIG. 9 is a cross-sectional view in the direction of line IX—IX of FIG. 8;

BEST MODE FOR CARRYING OUT THE INVENTION

The stated object, other characteristics and the present invention itself will be understood well by referring to the description of the embodiments of the present invention taken in conjunction with the accompanying drawings.

Figure 1:
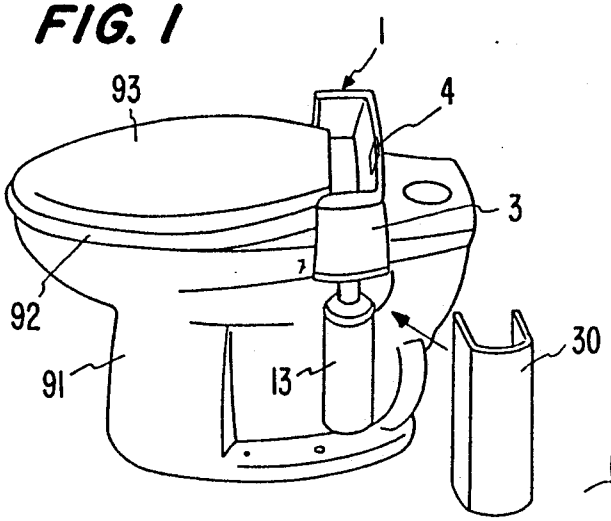
FIG. 1 is a perspective view of the apparatus mounted on the toilet stool according to the present invention.

FIG. 1 shows an embodiment of the apparatus of the present invention, the apparatus having a body (1) mounted in the rear portion of a toilet stool (91).

Figure 4:
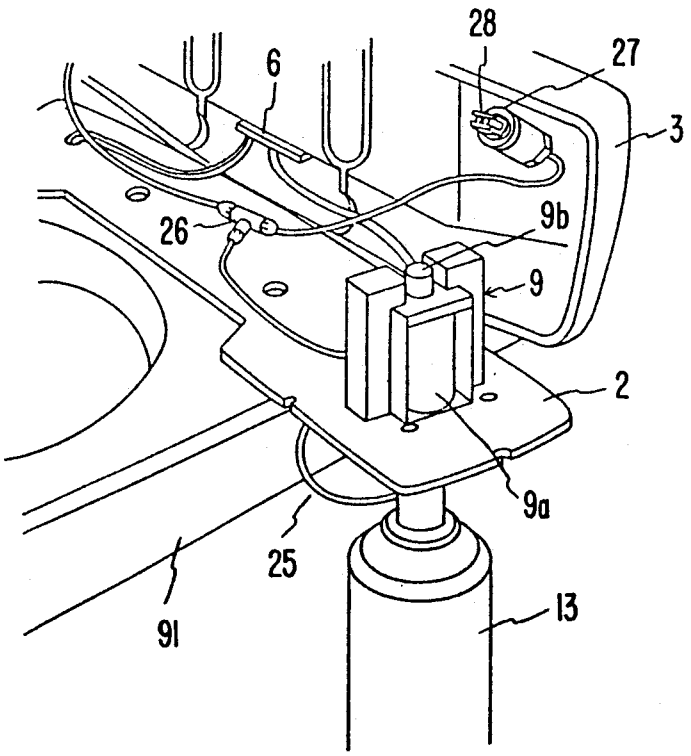
FIG. 4 is a perspective view of a main portion of the apparatus according to the present invention.

The body (1) comprises a base plate (2) shown is FIG. 4 and a body cover (3) attached over the base plate (2).

The base plate (2) is made of metal, plastic materials such as polycarbonate resin or other suitable materials and the body cover (3) is made of metal, plastic materials such as ABS resin or other suitable materials.

A cover plate (4) for a ray sensor unit is attached on a portion of the body cover (3) which is hidden behind the opened stool cover (93).

The cover plate (4) has a film, which allows transmission of infrared rays, in the center thereof.

Figure 3:
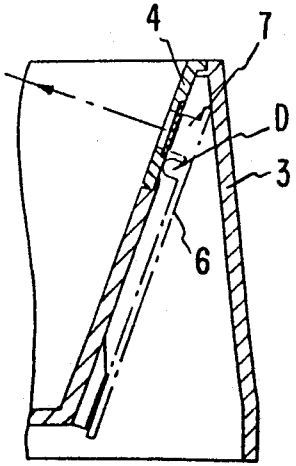
FIG. 3 is a cross-sectional view in the direction of line III—III of FIG. 2.

Behind the cover plate (4) a ray sensor unit is installed in the body cover (3), as shown in FIG. 3.

The ray sensor unit comprises a ray transmitter (7) and a ray sensor (8), as shown in FIG. 5.

The ray transmitter (7) transmits infrared rays through the cover plate (4) and the ray sensor (8) detects the reflected infrared rays through the cover plate (4).

Figure 2:
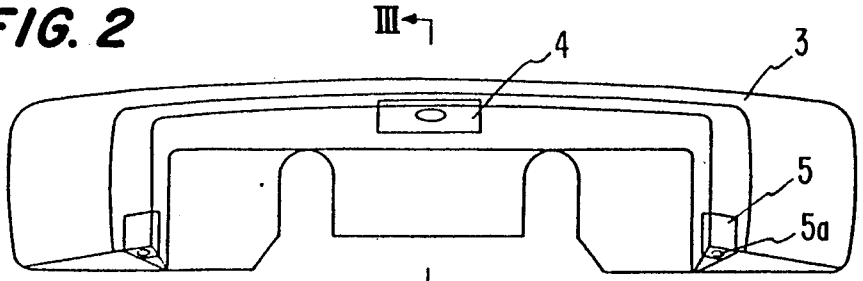
FIG. 2 is a plan view of the apparatus according to the present invention.

A nozzle (27) is installed behind a spray nozzle cover plate (5) on both sides of the body cover (3) and is aimed at the stool seat (92), as shown in FIG. 2 and FIG. 4.

The nozzle hole (28) of the nozzle (27) is positioned at the opening (5*a*) of the spray nozzle cover plate (5).

A disinfectant container (13) shown in FIG. 1 and FIG. 4 is easily exchangeably hung under one side of the base plate (2).

The container (13) contains pressurized (i.e. 3 $kg/cm^2$) liquid disinfectant therein.

FIG. 5 shows a controller circuit (6) of the apparatus of the present invention, the electric power source of the circuit (6) being a D.C. battery (10) or A.C.

The battery (10) may be a 12 volt (13 volt at full charge) lead-acid storage battery.

It is preferable that the battery (10) is accompanied by a warning circuit including a light emitting diode shown in FIG. 5 for indicating the voltage drop e.g. 13 to 12 volts.

It is also preferable that the electric power source be switchable to either a D.C. battery or A.C.

The controller circuit (6) is connected at its input to the ray sensor unit and is connected at its output to the solenoid plunger unit (9).

The solenoid plunger unit (9) shown in FIG. 4 and FIG. 5 comprises a solenoid coil (9*a*) and a plunger (9*b*) which is driven by the magnetic force of the solenoid coil (9*a*).

The end of the plunger (9*b*) extends to connect directly to a push button (23) of the disinfectant container (13).

The direct connection of the plunger (9*b*) is effective for saving electric power as no friction is generated.

The push button (23) shown in FIG. 7 is mounted to the head of a stem (14) of the container (13).

The stem 14 is forced to project upward by a spring (21) housed in a housing (19) of a disinfectant container (13), the force of the spring (21) pushing axially upwardly against the push button (23) and the plunger (9*b*) as well as the stem (14).

The details of the structure inside the head of the disinfectant container (13) are shown in FIG. 6 and FIG. 7.

In the head of the disinfectant container (13) the housing (19) is provided.

In the housing (19) the spring (21) is housed and the stem (14) is inserted therein through a packing (18) which seats the assembly.

In the free state shown in FIG. 6 the stem (14) is pushed up by the spring (21).

The force of the spring (21) makes the shoulder (17) of the stem (14) engage the packing (18).

The flow way (15) formed in the stem (14) communicates through a hole (16) with a chamber (20) of the housing (19).

In the free state, the hole (16) is choked by the engagement of the shoulder (17) of the stem (14) with the packing (18).

When the solenoid coil (9*a*) is electrically actuated, the plunger (9*b*) pushes axially downwardly against the push button (23) and the stem (14).

Thus, the hole (16) is opened and the flow way (15) communicates through the hole (16) with the chamber (20) of the housing (19).

As a consequence, the pressurized liquid disinfectant flows through the flow way (22), the housing (19), the hole (16), the flow way (15) and the flow way (24) of the push button (23) to a tube (25) connected to the flow way (24).

The tube (25) is connected to a flow divider (26) which is T-shaped and divides the disinfectant flow from the container (13) to the paired nozzles (27) provided on both sides of the body (1).

Operation of the apparatus of the present invention is initiated by a user of the toilet stool (91) opening the stool cover (93) from the condition shown in FIG. 1.

Consequently the stool cover (93) hides the front of the cover plate of the ray sensor unit (4).

The ray sensor unit detects the opening of the stool cover (93) through the voltage change provoked by the ray reflection from the cover (93).

The ray sensor unit informs the controller circuit (6) of the opening of the stool cover (93).

The controller circuit (6) electrically actuates the solenoid coil (9*a*) for a fixed time (e.g. 2 seconds) which is programmed in the controller circuit (6) beforehand.

The plunger (9*b*) pushes axially downwardly against the push button (23) and the stem (14) against the bias of the spring (21).

Consequently the hole (16) of the stem (14) is opened and liquid disinfectant flows into the flow way (24) of the push button (23) through the flow way (15) of the stem (14).

The liquid disinfectant flows through the tube (25) and the flow divider (2*b*) into the paired nozzles (27).

Figure 8:
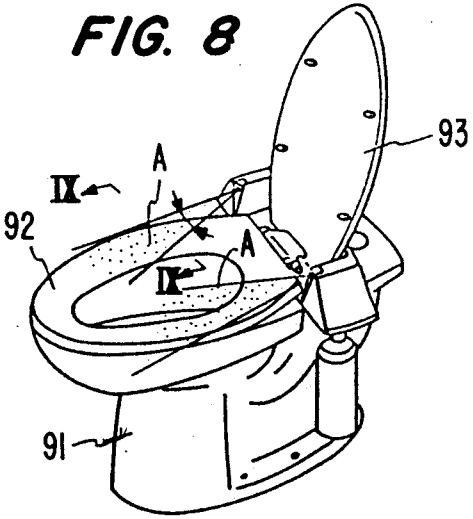
FIG. 8 is a perspective view of the apparatus spraying disinfectant to the stool seat according to the present invention.

As shown in FIG. 8 and FIG. 9, the liquid disinfectant is sprayed from the paired nozzles (27) to the surface of the stool seat (92).

The spray A of the disinfectant sterilizes the stool seat (92) and volatilizes to provide a dry surface thereof.

The spray A is preferably spread with the cross-section shown in FIG. 9 and is inclined downwardly about 10° from the horizontal plane such that it spreads about 15° horizontally.

The preferable disinfectant consists of the following components.

1. Benzalkonium chloride: 0.1 to 2% by weight (preferably 0.1 to 1% by weight)
2. Ethanol: 98 to 99.9% by weight (preferably 99 to 99.9% by weight)

The benzalkonium chloride to be used herein is not only effective to Gram positive bacteria but is also expected to be useful as a surfactant.

Ethanol itself is a disinfectant, exhibiting a bacteriocidal action in a short time and also functions as a solvent.

Further ethanol volatilizes in a short time from the surface of the stool seat after being sprayed and will not irritate the skin of the user.

Synergistic effects can be achieved by admixing plural kinds of disinfectant components.

The proportion of benzalkonium chloride is determined in view of both bacteriocidal action and preventing irritation to the skin of the user.

Further, for the ethanol it is desirable to utilize water-free denatured alcohol.

The disinfectant containing water-free denatured alcohol revealed higher bacteriocidal action than that of disinfectants containing other alcohols.

When the disinfectant is held in a container, it is more preferable to use water-free denatured alcohol as ethanol so as to inhibit corrosion of the container.

I claim:

1. A disinfecting apparatus for disinfecting a toilet seat of a toilet stool having front and rear portions, two opposing sides and a toilet seat cover, comprising:

a body adapted to be mounted to the rear portion of the toilet stool;

a ray sensor means mounted in said body for detecting an open condition of the toilet seat cover and outputting a signal indicative of the open condition;

a pressurized liquid disinfectant container having a selectively openable disinfectant flow way and a push button actuator means for opening said flow way;

a pair of nozzles in fluid communication with said flow way and adapted to be mounted, respectively, on two opposing sides of the toilet stool and aimed at the toilet seat;

a solenoid plunger unit operatively connected directly to said push button actuator means; and a controller means for activating said solenoid plunger unit upon receipt of said output signal from said ray sensor means so as to cause actuation of said push button actuation means to send disinfectant to said nozzles.

2. A disinfecting apparatus as recited in claim 1, wherein said ray sensor means comprises a means for transmitting an infrared ray.

3. A disinfecting apparatus as recited in claim 2, wherein said ray sensor means further comprises a means for receiving a reflected infrared ray.

4. A disinfecting apparatus as recited in claim 1, wherein said disinfectant container contains a disinfectant containing ethanol.

5. A disinfecting apparatus as recited in claim 4, wherein said ethanol comprises water-free denatured alcohol.

6. An apparatus comprising:

a toilet stool having front and rear portions, two opposing sides and a toilet seat cover;

a body mounted to said rear portion of said toilet stool;

a ray sensor means mounted in said body for detecting an open condition of said toilet seat cover and outputting a signal indicative of said open condition;

a pressurized liquid disinfectant container mounted to said toilet stool and having a selectively openable disinfectant flow way;

a pair of nozzles in fluid communication with said liquid disinfectant container, mounted to said toilet stool on said two opposing sides thereof, respectively, and aimed at said toilet seat; and a controller means for causing said selectively openable flow way to open and for causing liquid disinfectant to be sent from said disinfectant container to said nozzles upon receipt of said output signal from said ray sensor means.

7. A disinfecting apparatus as recited in claim 6, wherein said ray sensor means comprises a means for transmitting an infrared ray.

8. A disinfecting apparatus as recited in claim 7, wherein said ray sensor means further comprises a means for receiving a reflected infrared ray.

9. A disinfecting apparatus as recited in claim 6, wherein said disinfectant container contains a disinfectant containing ethanol.

10. A disinfecting apparatus as recited in claim 9, wherein said ethanol comprises water-free denatured alcohol.

11. An apparatus as recited in claim 6, wherein said disinfectant container includes a push button actuator means for opening said flow way;

a solenoid plunger unit is operatively connected directly to said push button actuator means; and said controller means is operable to activate said solenoid output signal from said ray sensor means so as to cause actuation of said push button actuator means to send said disinfectant to said nozzle.

* * * * *